United States Patent [19]

Johnston et al.

[11] Patent Number: 4,795,365

[45] Date of Patent: Jan. 3, 1989

[54] CABLE/WIRE SPLICE DEVICE

[75] Inventors: Gordon R. Johnston, Philadelphia; Walter M. Werner, Downingtown, both of Pa.

[73] Assignee: AMP Incorporated, Harrisburg, Pa.

[21] Appl. No.: 146,071

[22] Filed: Jan. 20, 1988

Related U.S. Application Data

[63] Continuation-in-part of Ser. No. 64,153, Jun. 18, 1987, abandoned.

[51] Int. Cl.[4] ..... H01R 4/24

[52] U.S. Cl. ..... 439/411; 439/791; 439/796; 439/807; 439/863

[58] Field of Search ..... 439/411–413, 439/418, 431, 781–783, 791, 794, 796–798, 807, 815, 863

[56] References Cited

U.S. PATENT DOCUMENTS

| | | | |
|---|---|---|---|
| 1,469,107 | 9/1923 | Phillips, Jr. | 439/807 |
| 1,665,048 | 4/1928 | Weimer et al. | 439/431 |
| 2,193,202 | 3/1940 | Millermaster | 439/811 |
| 2,691,772 | 10/1954 | Hixon | 439/807 |
| 2,901,725 | 8/1959 | Schuyler | 439/797 |
| 3,041,574 | 6/1962 | Cornell, Jr. | 439/801 |
| 3,864,013 | 2/1975 | Levy | 439/797 |
| 4,103,984 | 8/1978 | Mixon, Jr. | 339/98 |
| 4,127,354 | 11/1978 | Mixon, Jr. | 403/279 |
| 4,478,479 | 10/1984 | Cherry et al. | 339/273 R |

FOREIGN PATENT DOCUMENTS

| | | | |
|---|---|---|---|
| 702365 | 2/1941 | Fed. Rep. of Germany | 439/806 |
| 2436888 | 2/1976 | Fed. Rep. of Germany | 439/418 |
| 46302 | 3/1919 | Sweden | 439/781 |
| 148725 | 8/1920 | United Kingdom | 439/807 |

*Primary Examiner*—Joseph H. McGlynn
*Attorney, Agent, or Firm*—Allan B. Osborne

[57] ABSTRACT

A splice device for in-line splicing of two cables, wires or the like. More particularly, the device includes a body member having axial extending apertures in each end face and transversely extending passages intersecting the apertures. Wedge members, having threaded ends, are positioned in the transverse passages with the threaded ends extending out of the body member of receiving nuts so that the wedge members can be drawn tightly in the passages and thereby securely wedging cables positioned in the apertures.

13 Claims, 3 Drawing Sheets

Fig. 2
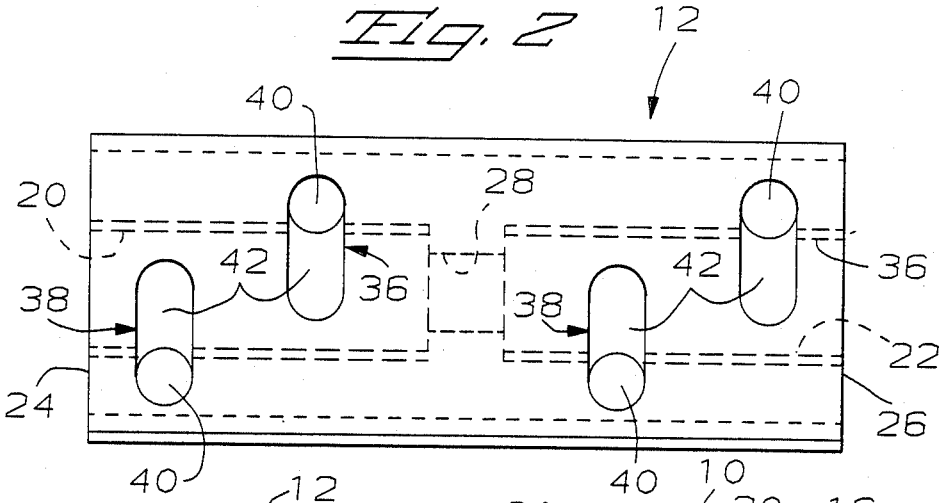
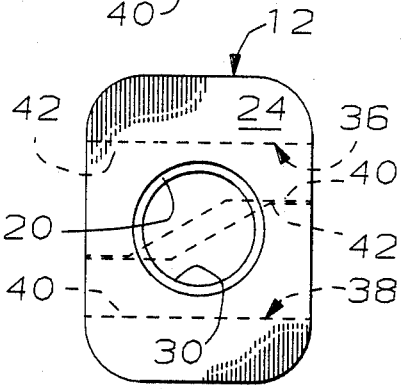
Fig. 3
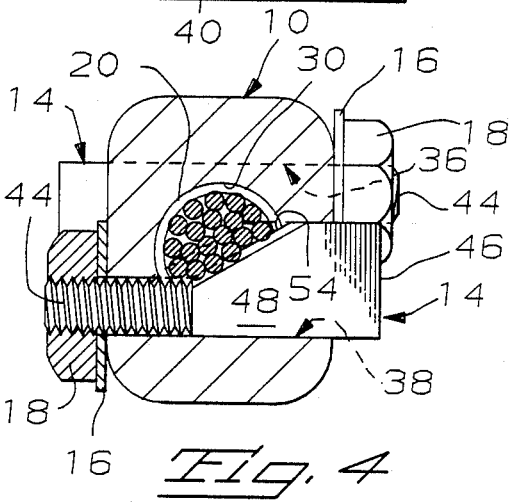
Fig. 4
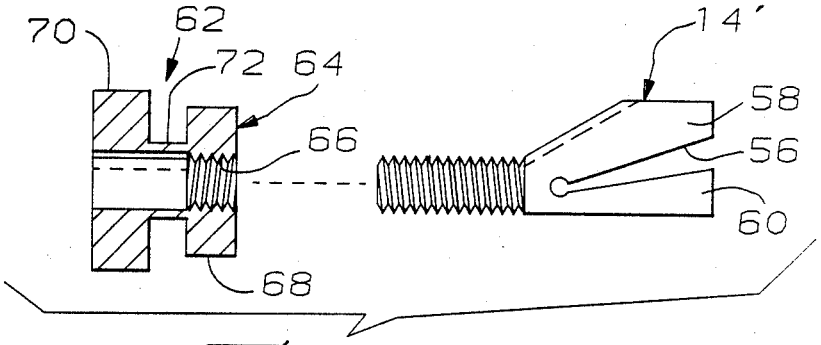
Fig. 5

CABLE/WIRE SPLICE DEVICE

This is a continuation-in-part of prior application Ser. No. 064,153, filed June 18, 1987, entitled "A Cable/-Wire Splice Device" by Gordon Ray Johnston and Walter Myers Werner, and now abandoned.

FIELD OF THE INVENTION

The present invention relates to a device for use in splicing cables or wires together by using wedge members for clamping and securing the cables or wires in a body member.

BACKGROUND OF THE INVENTION

U.S. Pat. No. 4,478,479 discloses an electrical terminal which includes an elongated body having an axial, wire receiving passage and a transverse passage through which a wedge member is driven by means of an explosive or ram reciprocating tool to secure the wire therein. The wedge member includes a leading end which, in cooperation with a notch in the elongated body, is bent out of line of the transverse passage to thereby lock the wedge member in place. Although this type electrical terminal provides a reliable means for splicing a pair of wires together, it was intended for permanent installations and not for disassembly and re-use.

It is therefore desirable to provide a splice device for all types of cable and wire which can be assembled, disassembled and re-assembled as often as necessary. Further, it is desirable to provide a device with which an ordinary wrench can be used in the assembly and disassembly.

SUMMARY OF THE INVENTION

According to the invention, a splice device is provided which includes a body member having axial apertures extending thereinto at each end or channels and intersecting passages crossing the body member Wedge members, disposed in the intersecting passages, include a threaded end extending outwardly from the body member for receiving a threaded nut and a beveled surface for engaging cables in the apertures or channels upon drawing the wedge members tightly in the passages by tightening the nuts with a wrench.

BRIEF DESCRIPTION OF THE DRAWINGS

FIG. 2 is a side view of the body member of the device;

FIG. 3 is an end view of the body member of the device;

FIG. 4 is a sectioned end view of the device in which a cable is secured;

FIG. 5 is a side view of an alternate embodiment of the wedge member and nut;

DESCRIPTION OF THE INVENTION

Figure 1:
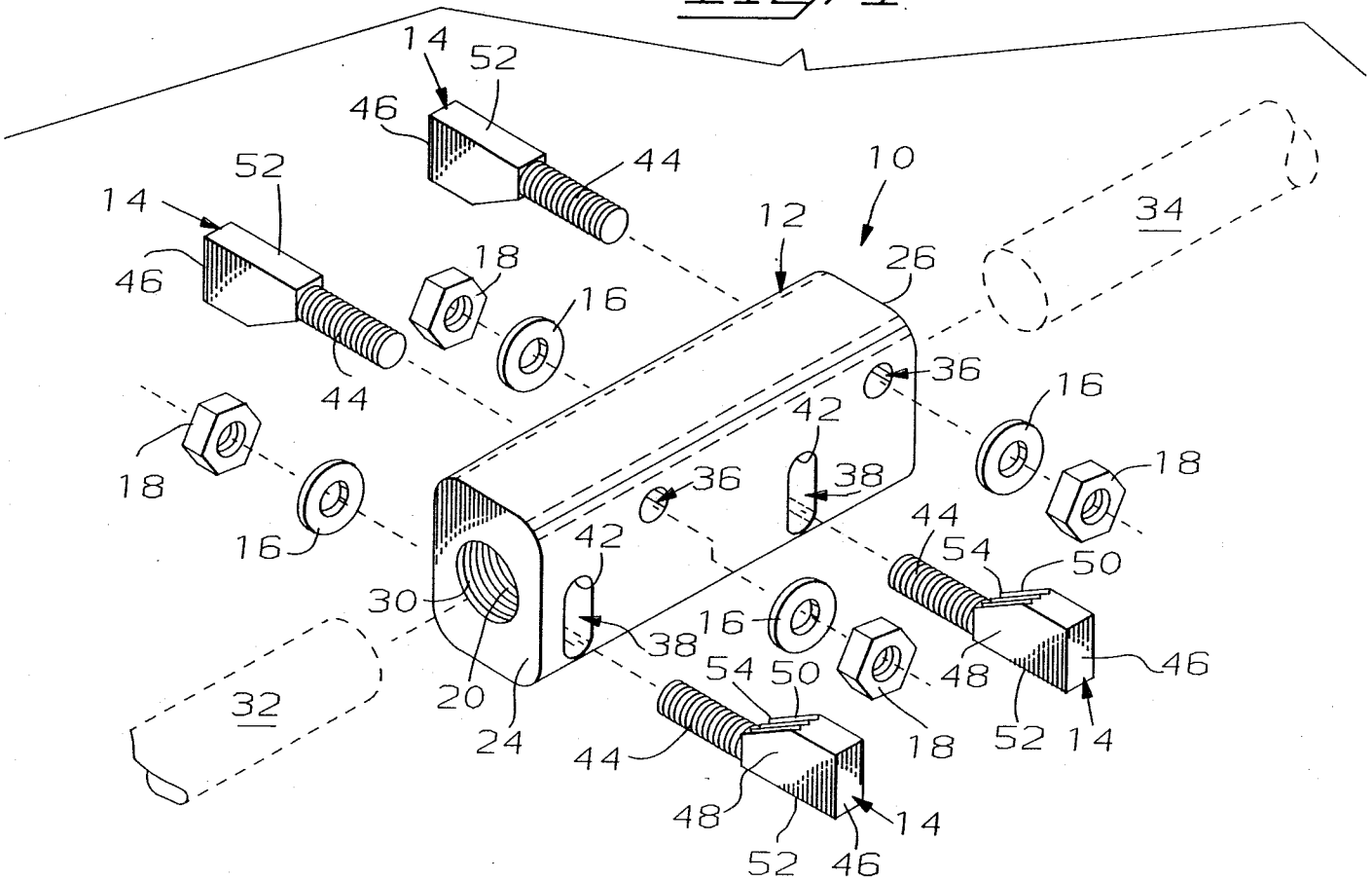
FIG. 1 is an exploded, perspective view of the splice device of the present invention.

Splice device 10 as shown in FIG. 1 includes body member 12, wedge members 14, washers 16, and nuts 18. Members 12 and 14 are preferably made from 6061-T aluminum although other suitable materials may be used.

With reference to both FIGS. 1 and 2, member 12 is elongated with axial apertures 20,22 opening at respective end faces 24,26 and interconnected, if so desired, by passage section 28 shown in phantom in FIG. 2. apertures 20,22 may be circumferentially serrated as indicated by reference numeral 30 to provide a biting surface for cables 32,34.

Preferably, each aperture 20,22 is intersected by two transverse passages, a first passage 36 and a second passage 38, which extend across body member 12. As shown, first passages 36 intersect apertures 20,22 on one side thereof and second passages 38 intersect apertures 20,22 on an opposite side thereof. Passage 36,38 include segment 40 opening on one or the other side of member 12 and an enlarged segment 42 which may be oral shaped as shown or rectangular, opening on the opposite side. Preferably, each set of first and second passages 36,38 for each respective aperture 20,22 are reversely oriented as shown in FIG. 1 and as shown in FIG. 3 in phantom. As will be described below, this arrangement clamps cables 32,34 into a tortuous path in respective apertures 20,22.

Wedge members 14 include a threaded end 44 at one end, rectangular block section 46 at another end and wedge section 48 therebetween. As shown in FIG. 1, edge surface 50 of wedge section 48 converges towards opposing edge surface 52 and is axially serrated to provide elongated ridges or teeth 54. Washers 16 and nuts 18 are conventional.

Wedge members 14 are positioned in transverse passages 36,38 with the threaded end 44 in segment 40 and extending outwardly from body member 12, block section 46 in enlarged segment 42 and wedge section 48 within respective axial apertures 20,22.

Splice device 10 may be provided with wedge members 14 loosely positioned in respective transverse passages 36,38 as described above with washers 16 and nuts 18 just threaded onto threaded ends 44.

The steps in splicing cables 32,34 would generally begin with stripping insulation (not shown) from the ends thereof. In the event such insulation is thin enough, this step could be deleted as teeth 54 on wedge members 14 would cut therethrough. Cables 32,34 are then inserted into respective apertures 20,22 and, with the use of a wrench, wedge members 14 are drawn further into body member 12 with beveled surfaces 50 on wedge sections 48 engaging cables 32,34, compressing and securing them in the respective apertures 20,22 as shown in FIG. 4. Teeth 54 on beveled surfaces 50 will bite through insulation, if any, and oxides on cables 32,34 to provide a clean contact therebetween. Further, with the opposing orientation of transverse passages 36,38 in each aperture 20,22, each cable 32,34 is compressed in from opposite sides so that the tensile forces required to pull the cables from splice device 10 is substantial. serrations 30 in apertures 20,22 also provide retention against pull-out.

Cables 32,34 can be disengaged by simply loosening nuts 18 and tapping the free ends of threaded ends 44. Note that wedge members 14 need not be completely withdrawn from body member 12. As is obvious, from the foregoing, device 10 can be used over and over again.

FIG. 5 illustrates wedge member 14' wherein slot 56, extending through block section 46 and into wedge section 48, provide a pair of spring members 58,60. Upon drawing wedge 14' into body member 12, spring members 58,60 are resiliently compressed so that, should cables 32,34, in the case such are aluminum, creep, spring members 58,60 will expand to take up the slack and thereby continue to grip cables 32,34.

FIG. 5 also illustrates a hex torque nut 62 which can be used in lieu of nut 18. Nut 62 includes at one end section 64 having threaded passage 66 and four or six wrench-receiving flats 68 and hex head portion 70 at the opposite end with frangible shaft 72 thereinbetween. As is well known, frangible shaft 72 will shear off at a given torque load being applied thereto so that wedge member 14 or wedge member 14' will not be drawn too deeply into body member 12. Flats 68 provide a means for unthreading nut 62 from wedge members 14,14' as the case might be.

Figures 6, 7, 8:
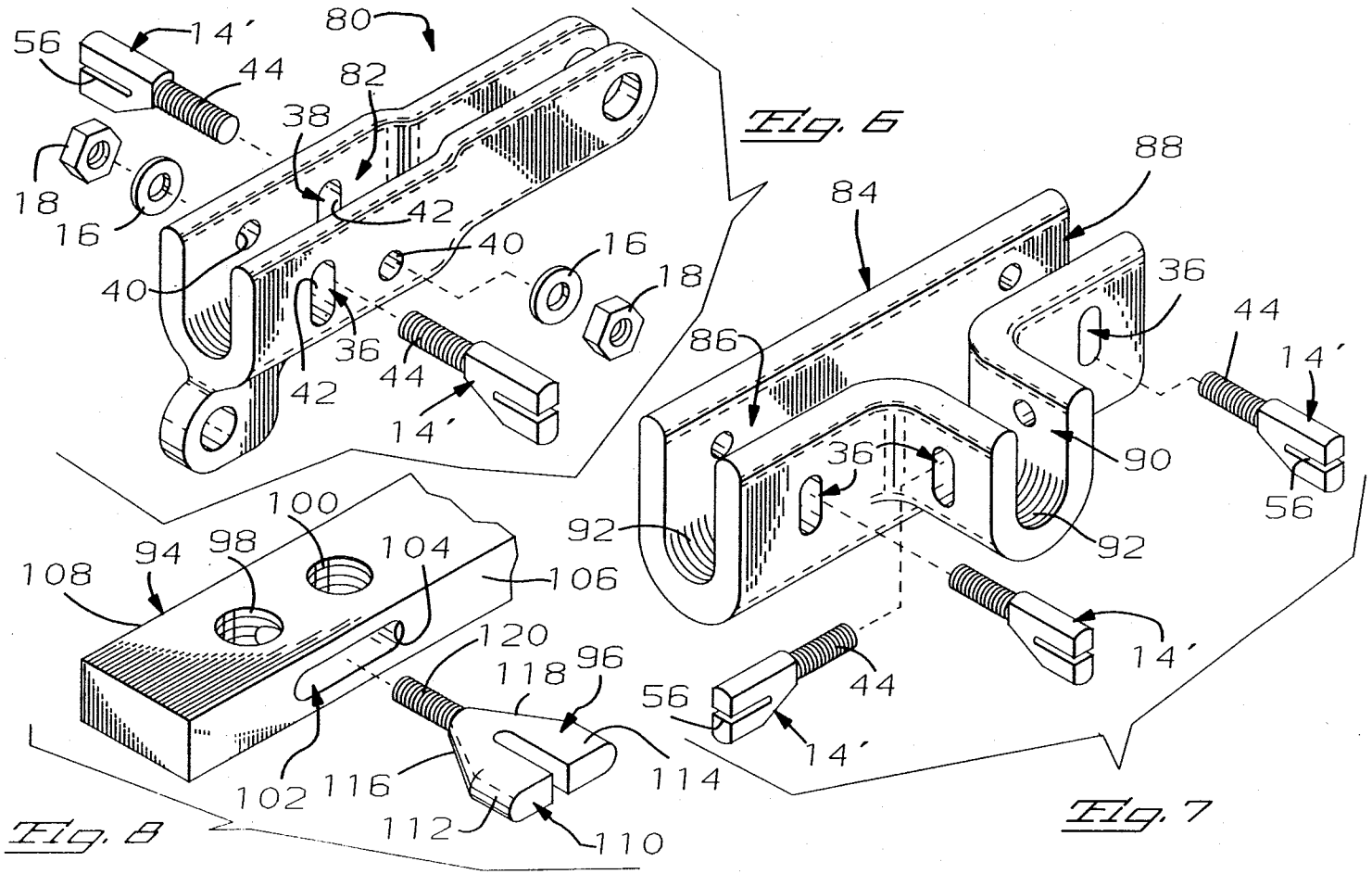
FIGS. 6, 7 and 8 are perspective views of other embodiments of the splice device of the present invention.

FIGS. 6, 7 and 8 illustrate other embodiments of splice device 10. As shown in FIG. 6, body member 80 is provided with an open cable channel 82 and a pair of transverse passages 36,38 with segments 40,42. Member 80 secures a single cable (not shown) in channel 82 with both wedge members 14' crossing over the cable.

Body member 84 shown in FIG. 7 is T-shaped and includes open cable channels 86, 88 and 90 with the latter being perpendicular to channels 86,88. Preferably channels 86, 88 and 90 intersect each other as shown. Here again, wedge members 14' secure cables (not shown) by crossing over them so as to compress them against channel floors 92. Although only transverse passages 36 are shown, passages 38 could be included if desired. Body member 84 is suitable for use with cables (not shown) in each channel 86, 88 and 90 or one cable extending through channels 86,88 and one cable in channel 90.

The embodiment shown in FIG. 8 includes body member 94 and double wedge member 96. Body member 94 is provided with a pair of spaced-apart cable passages 98,100 and one transverse opening 102 which extends between and intersects both passages 98,100. Opening 102 includes an enlarged segment 104 opening out on side surface 106 of member 94 and a smaller segment (not shown) opening out on opposite side surface 108.

Double wedge member 96 includes block section 110 at one end which is slotted to provide a pair of spring members 112,114. Member 96 further includes oppositely facing wedge sections 116,118 in conjunction with respective spring members 112,114. Threaded end 120 extends outwardly from wedge sections 116,118 which converge at the junction therewith. In use, cables (not shown) are inserted into passages 98,100 and secured therein by inserting wedge member 96 into opening 102 with wedge sections 116,118 engaging and compressing them in passages 98,100. As with the previous embodiments, wedge member 96 is secured to body member 94 by a nut; e.g., nut 18, FIG. 6, being threaded onto threaded end 120 projecting outwardly from side 108 of member 94.

As can be discerned, a splice device for the in-line splicing of two cables or wires has been disclosed. The device includes a body member having axial apertures at each end for receiving the cable and transverse passages, intersecting the axial apertures, for receiving wedge members having a beveled edge surface for engaging the cables and a threaded end projecting out from the body member. Nuts on the threaded ends draw the wedge members in tightly against the cables to compress and secure them in the apertures. The cables can be disengaged by simply loosening the nuts and wedge members.

I claim:

1. A splice device for in-line splicing and two cables or the like, comprising:

an elongated body means having a pair of axial aperture means in respective ends for receiving cables therein and transverse passage means intersecting each axial aperture means, said transverse passage means including a first segment opening on a side of said body means;

wedge means having threaded first ends beveled surfaces and compressible spring means, said wedge means being disposed in said transverse passage means with said threaded first ends extending outwardly from said body means through said first segment openings of said transverse passage means and said beveled surfaces in said axial aperture means; and threaded means for being threaded onto said threaded first ends and against said body means to draw said beveled surfaces on said wedge means against cables which may be in said axial aperture means to thereby compress and secure such therein and further to compress said spring means to provide a continuous securing force against the cables.

2. The splice device of claim 1 further including axial serrations on said beveled surfaces on said wedge means.

3. The splice device of claim 1 wherein said axial aperture means are circumferentially serrated.

4. The splice device of claim 1 wherein there are a pair of transverse passage means intersecting each of said pair of axial aperture means.

5. The splice device of claim 4 wherein one of each pair of transverse passage means intersects said aperture means on one side thereof and the other of said each pair of transverse passage means intersect said aperture means on an opposite side thereof.

6. The splice device of claim 5 wherein the first segment of one of each pair of transverse passage means opens on an opposite side of said body means relative to the other of each pair.

7. The splice device of claim 6 wherein said transverse passage means include a second segment of larger dimensions than said first segment and which opens on a side of said body means opposite the opening of said first segment.

8. The splice device of claim 7 wherein said wedge means includes second ends of larger size than said first ends, said second ends being disposed in said second segments of said transverse passage means.

9. The splice device of claim 8 wherein said compressible spring means include a slot located in said second ends, said slot being parallel to the plane of said beveled surface.

10. A splice device for securing a cable, comprising:

an elongated body member having a channel defined by two, spaced-apart, parallel walls and a floor joining said walls, said walls having an aligned passage therethrough which is transverse to said channel;

a wedge member having a projecting end, a beveled surface and compressible spring means, said wedge member being disposable in said transverse passage with said projecting end projecting laterally outwardly from said body member and said beveled surface engaging a cable which may be in said channel to thereby compress such against said floor; and securing means adapted to be attached to said projecting end for securing said wedge member in said transverse passage and to compress said compressible spring means to provide a continuous compressible force against the cable.

11. A splice device for in-line splicing of two cables, comprising:

an elongated body member having first and second channels each at a respective end thereof, said channels being defined by two, spaced-apart, parallel walls and a floor joining said walls, said walls having openings therethrough with said openings in one wall being in alignment with openings in another wall;

a plurality of wedge members, each having a projecting end, a beveled surface and compressible springs means, said wedge members being disposable in said openings with said projecting ends extending laterally outwardly from said body member and said beveled surfaces engaging cables which may be in said channels to thereby compress such against said floors; and means, attachable to said projecting ends, for securing said wedge members in said openings, and to cause said spring means to be resiliently compressed and thereby exert a continuing force against the cables.

12. The splice device of claim 11 wherein said body member includes a third channel positioned at an angle with respect to said first and second channels and located therebetween.

13. The splice device of claim 11 wherein said wedge members include a block section on an end opposite said projecting end and said compressible spring means include a slot in said block section with said slot extending across the thickness thereof.

* * * * *